US005992970A

United States Patent [19]

Unosawa et al.

[11] Patent Number: 5,992,970

[45] **Date of Patent: *Nov. 30, 1999**

[54] RECORDING APPARATUS WITH ENHANCED POSITIONAL ACCURACY OF RECORDING HEAD CARRIAGE

[75] Inventors: Yasuhiro Unosawa, Tokyo; Makoto Kashimura, Yokohama; Makoto Takemura, Tokyo; Toshiyuki Onishi; Tetsuhiro Nitta, both of Yokohama; Satoshi Saikawa, Inagi; Hiroshi Yoshino, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/789,603

[22] Filed: Jan. 24, 1997

Related U.S. Application Data

[63] Continuation of application No. 08/294,862, Aug. 29, 1994, abandoned.

[30] Foreign Application Priority Data

Sep. 3, 1993 [JP] Japan ..... 5-219807

[51] Int. Cl.[6] ..... B45I 23/00; B41J 2/165

[52] U.S. Cl. ..... 347/37; 347/22; 347/30

[58] Field of Search ..... 347/19, 22, 23, 347/29, 30, 32, 37, 234, 235, 248, 250; 346/139 R; 400/280, 306.1

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hari | 347/66 |
| 4,627,043 | 12/1986 | Uehara | 369/215 |
| 4,725,129 | 2/1988 | Endo et al. | 347/56 |
| 4,740,796 | 4/1988 | Endo et al. | 347/56 |
| 5,105,210 | 4/1992 | Hirano et al. | 346/145 |
| 5,116,150 | 5/1992 | Courtney | 400/320 |
| 5,331,680 | 7/1994 | Ueno | 377/17 |
| 5,450,106 | 9/1995 | Morioka et al. | 347/37 |
| 5,455,609 | 10/1995 | Gast et al. | 347/32 |

FOREIGN PATENT DOCUMENTS

| | | | |
|---|---|---|---|
| 0442713 | 8/1991 | European Pat. Off. . | |
| 54-056847 | 5/1979 | Japan . | |
| 59-123670 | 7/1984 | Japan . | |
| 59-138461 | 8/1984 | Japan . | |
| 59-178277 | 10/1984 | Japan . | |
| 60-071260 | 4/1985 | Japan . | |
| 5-147268 | 6/1993 | Japan | 347/37 |
| 2211330 | 6/1989 | United Kingdom . | |

*Primary Examiner*—N. Le
*Assistant Examiner*—Craig A. Hallacher
*Attorney, Agent, or Firm*—Fitzpatrick, Cella, Harper & Scinto

[57] ABSTRACT

The present invention provides a recording apparatus which can determine a position of a carriage on which a recording head is mounted with high accuracy without enhancing positional accuracy of a carriage position detecting system. In this recording apparatus, a rod-like member is moved upwardly to be engaged by a recessed portion formed in the carriage. A deviation amount of the carriage generated by such engagement is detected by a linear encoder and is used as a correction value when the carriage is moved next time.

8 Claims, 10 Drawing Sheets

RECORDING APPARATUS WITH ENHANCED POSITIONAL ACCURACY OF RECORDING HEAD CARRIAGE

This application is a continuation of application Ser. No. 08/294,862 filed Aug. 29, 1994, now abandoned.

BACKGROUND OF THE INVENTION

1. Field of the Invention

The present invention relates to a recording apparatus, and more particularly, it relates to a recording apparatus having an encoder for detecting a position and a speed of a carriage on which a recording head is mounted.

2. Related Background Art

In so-called serial recording apparatuses wherein recording is effected by moving a carriage on which a recording head is mounted along a guide shaft, a magnetic linear encoder, an optical linear encoder or the like has been used to detect a position and a speed of the carriage.

In the recording apparatuses having the magnetic linear encoder, a magnetic scale portion is arranged in the apparatus, and a detection portion comprised of an MR element (ferromagnetic reluctance effect element) is arranged on the carriage shiftable relative to the scale portion. On the other hand, in the recording apparatuses having the optical linear encoder, a scale portion formed from a slit-shaped film is arranged in the apparatus, and a reading portion having a sensor of light-permeable type or light-reflection type is attached to the carriage shiftable relative to the scale portion.

In such recording apparatuses, in order to determine address of the scale of the (magnetic or optical) linear encoder, the following method has been adopted.

That is to say, a photo-interrupter is arranged in the apparatus independently from the linear encoder, so that all of the addresses on the entire area of the scale can be determined on the basis of a reference position of the scale where an optical axis of the photo-interrupter is blocked by a portion of the carriage. And, on the basis of the address of the scale determined by this method, a shift position of the carriage is determined and the recording is effected by the recording head mounted on the carriage at that shift position. Further, when the recording head is of ink jet type, a sucking operation or a capping operation is effected at a predetermined position on the basis of the address of the scale as ink discharge recovery treatment for the recording head.

By the way, in the above-mentioned conventional techniques, since the photo-interrupter is arranged in the apparatus independently from the linear encoder to determine the address of the scale of the linear encoder, in order to correctly or accurately determine the address of the scale, dimensional accuracy of parts of the photo-interrupter itself, attachment accuracy of the photo-interrupter to the apparatus and switching accuracy of signal output when the optical axis of the photo-interrupter is blocked by the portion of the carriage must be enhanced.

Further, in consideration of the ink jet recording apparatus wherein the sucking operation and the capping operation for the recording head are required, in order to perform positive sucking and capping operations, attachment accuracy of a recovery unit (for effecting the sucking and capping operations) with respect to the attachment position of the photo-interrupter must also be enhanced, as well as the above-mentioned accuracies.

Accordingly, if various dimensional errors are accumulated, sure capping operation and/or sucking operation cannot be performed.

SUMMARY OF THE INVENTION

The present invention aims to eliminate the above-mentioned conventional drawbacks, and an object of the present invention is to provide a recording apparatus which can determine correct address of a scale of an encoder and can control a position of a carriage with high accuracy, without enhancing dimensional accuracy of each of parts constituting the recording apparatus.

Another object of the present invention is to provide an ink jet recording apparatus wherein a sucking operation and a capping operation for a recording head can positively be effected by bringing a carriage to an operating position with high accuracy.

To achieve the above objects, according to the present invention, there is provided a recording apparatus comprising a movable carriage on which a recording head for recording an image on a recording medium is mounted, an encoder means for detecting a moving position of the carriage, a member arranged at a predetermined position within the recording apparatus in a moving path of the carriage so that it can be contacted with a portion of the carriage, a detection means for detecting a moved amount of the carriage in a carriage moving direction generated when the carriage is contacted with the above-mentioned member, and a correction means for correcting the moving position detected by the encoder means, on the basis of the moved amount detected by the detection means and the predetermined position where the above-mentioned member is arranged.

With this arrangement, when the member which can be retractable from the moving path of the carriage is contacted with the portion of the carriage, the moved amount of the carriage generated by the contact between the member and the carriage is detected, and the moving position of the carriage detected by the encoder means can be corrected on the basis of the detected moved amount and the predetermined position where the member is arranged.

As mentioned above, according to the present invention, when the member which can be retractable from the moving path of the carriage is contacted with the portion of the carriage, the moved amount of the carriage generated by the contact between the member and the carriage is detected, and the moving position of the carriage detected by the encoder means can be corrected on the basis of the detected moved amount and the predetermined position where the member is arranged.

As a result, the moving position of the carriage can be controlled with high accuracy, and the suck operation and the capping operation for the recording head can positively be performed by bringing the carriage to the moving position with high accuracy.

DETAILED DESCRIPTION OF THE PREFERRED EMBODIMENTS

The present invention will now be fully explained in connection with embodiments thereof with reference to the accompanying drawings.

First Embodiment

Figure 1:
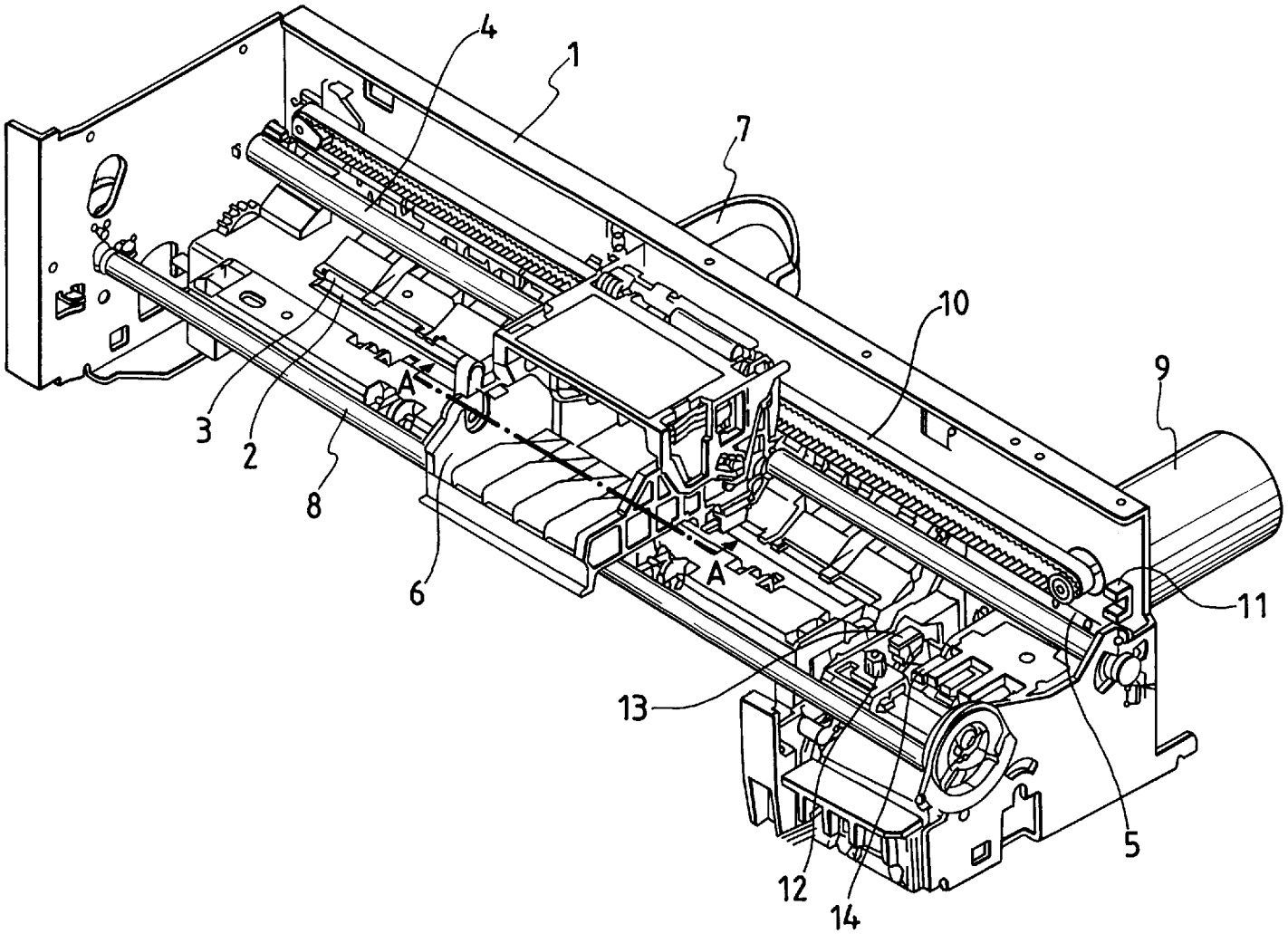
FIG. 1 is a perspective view of a main portion of a recording apparatus according to a preferred embodiment of the present invention.

FIGS. 1 to 5 relate to a recording apparatus according to a first embodiment of the present invention, and FIG. 1 is a perspective view of a main portion of the recording apparatus.

In FIG. 1, the recording apparatus has a chassis 1 as a base to which various constructural elements are attached. A sheet feed roller 2 is arranged along a longitudinal direction of the recording apparatus and serves to convey a recording sheet (not shown), and a pinch roller 3 is arranged in parallel with the sheet feed roller 2 and serves to urge the recording sheet against the sheet feed roller 2. A guide shaft 4 is arranged in parallel with and in a confronting relation to the sheet feed roller 2, and a carriage 6 can be moved along the guide shaft 4. A scale portion 5 of a magnetic linear encoder is arranged in parallel with and in a confronting relation to the guide shaft 4. The recording apparatus further includes a flexible substrate 7 through which a recording data signal is sent from a control portion to a recording head (not shown) mounted on the carriage 6 and an output signal is sent from a sensor (not shown) of the magnetic linear encoder to the control portion. A support shaft 8 is arranged in parallel with the guide shaft 4 and serves to hold a posture of the carriage 6 rotatable around the guide shaft 4. The recording apparatus further includes a carriage motor 9 for scanning the carriage 6 along the guide shaft 4, a timing belt 10 for transmitting a driving force of the carriage motor 9 to the carriage 6, a photo-interrupter 11 disposed within a scanning area of the carriage 6 to set a reference position regarding the scanning of the carriage 6, and a rod-like member 12 arranged on the recording apparatus so that it can be engaged by a portion of the carriage 6 when a position of the carriage 6 is determined, which will be described later. There are also provided a suction cap 13 used for preventing and recovering poor discharge of the recording head (not shown), and a protection cap 14 for preventing the drying of ink in discharge openings of the recording head when the recording head is in a waiting condition.

FIGS. 2 to 5 are sectional views of the carriage 6 positioned in a capping position or therearound, taken along the line A—A in FIG. 1. In FIGS. 2 to 5, the carriage 6 is provided with a recessed portion 6*a* into which the rod-like member 12 can be fitted.

In FIG. 1, the recording sheet (not shown) is intermittently fed by a predetermined amount by means of the sheet feed roller 2 and the pinch roller 3. On the other hand, the carriage 6 is scanned or shifted along the guide shaft 4 arranged in the confronting relation to the sheet feed roller 2, during which the recording of a width corresponding to the predetermined amount is effected by discharging ink from the recording head mounted on the carriage 6.

Operating positions of the carriage 6 in the above-mentioned series of recording operations and other auxiliary operations (for example, an ink discharging position, a position where the sucking operation for the recording head is effected, a capping position and the like) are determined by reading magnetic information formed on the scale portion 5 of the magnetic linear encoder by means of a sensor portion of the magnetic linear encoder arranged on the carriage 6. The magnetic information formed on the scale portion 5 of the magnetic linear encoder does not initially include addresses representative of inherent positions of the carriage, but the following process is performed to determine the addresses.

In FIG. 1, first of all, the carriage 6 is scanned or moved to the right. Meanwhile, the sensor portion (not shown) arranged on the carriage 6 continues to read the magnetic information on the scale portion 5 continuously. Thereafter, an optical axis of the photo-interrupter 11 is blocked by a shield plate (not shown) as a portion of the carriage 6. At this point, a position of the carriage 6 is used as a reference position (referred to as "home position" hereinafter), and the above-mentioned ink discharging position, sucking recovery position for the recording head, capping position and the like are determined on the basis of the home position.

Figure 2:
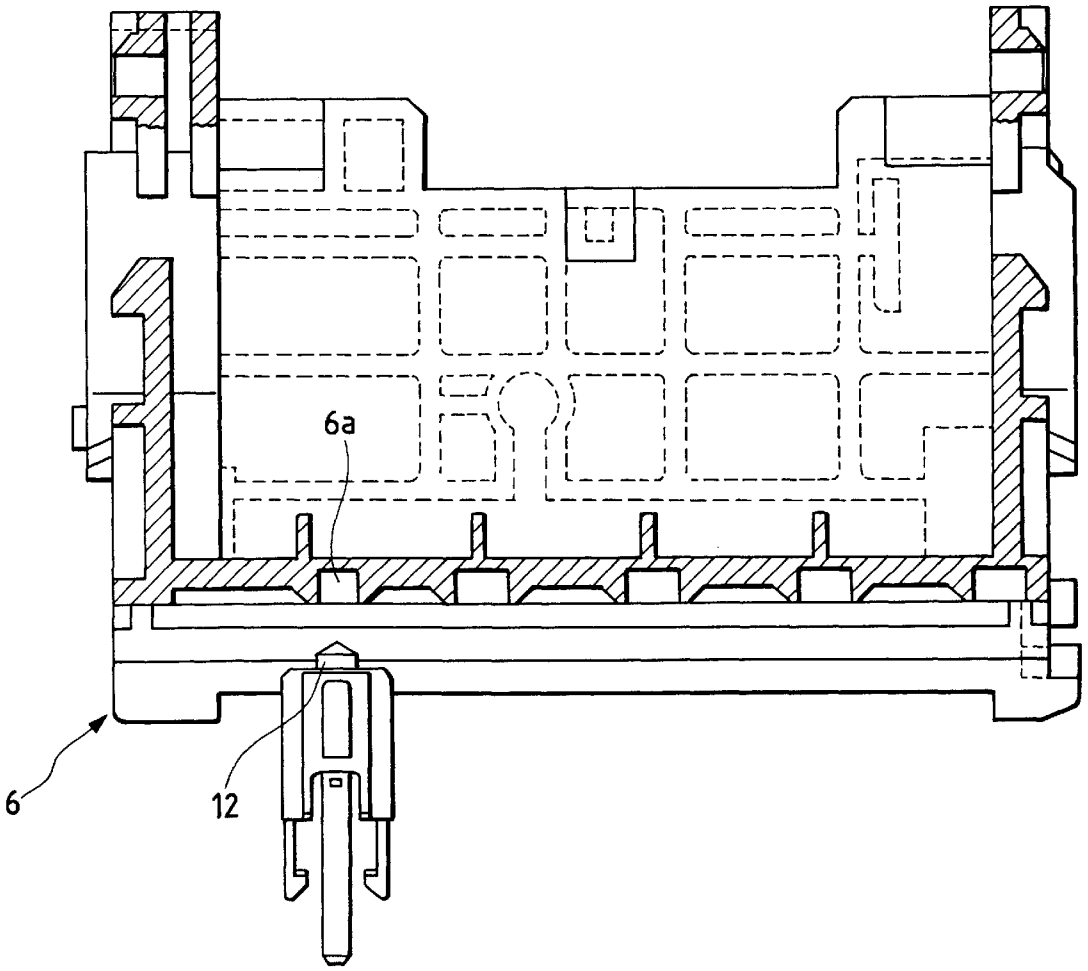
FIG. 2 is a sectional view taken along the line A—A in FIG. 1, showing a condition that a carriage is in a cap position.

Then, the carriage 6 is moved to the capping position determined on the basis of the home position. This condition is shown in FIG. 2.

Figure 3:
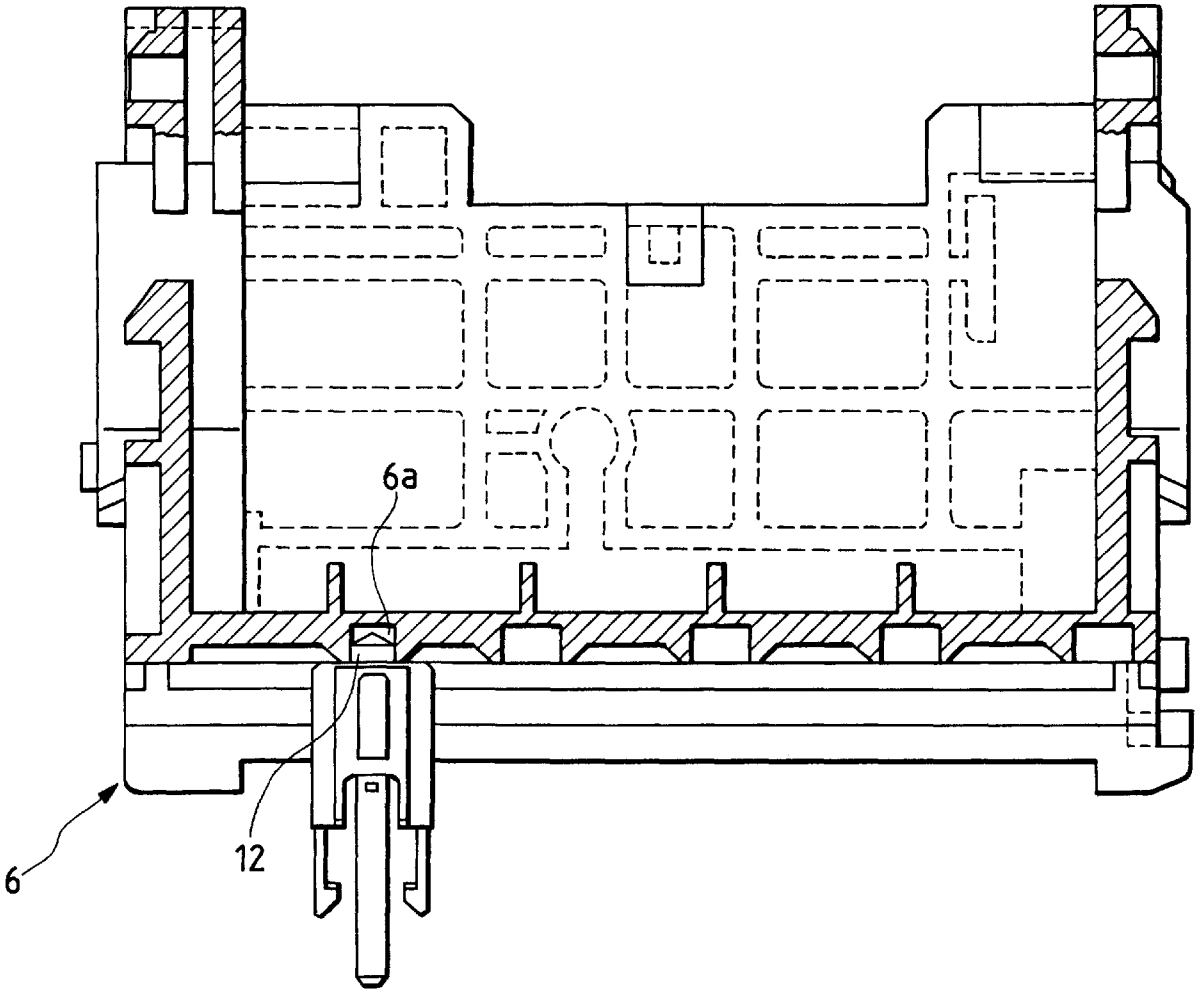
FIG. 3 is a sectional view similar to FIG. 2, showing a condition that a rod-like member is moved in an upward direction.

The rod-like member 12 is mounted for upward movement. FIG. 3 shows a condition that the rod-like member 12 is moved in an upward direction. When the position to which the carriage 6 was moved on the basis of the home position is coincided with a position in design (design position), as shown in FIG. 3, the rod-like member 12 can easily be fitted into the recessed portion 6*a* of the carriage 6. However, in many cases, the position of the carriage determined on the basis of the home position is offset from the design position because of dispersion in dimensional accuracy of various constructural parts.

Figure 4:
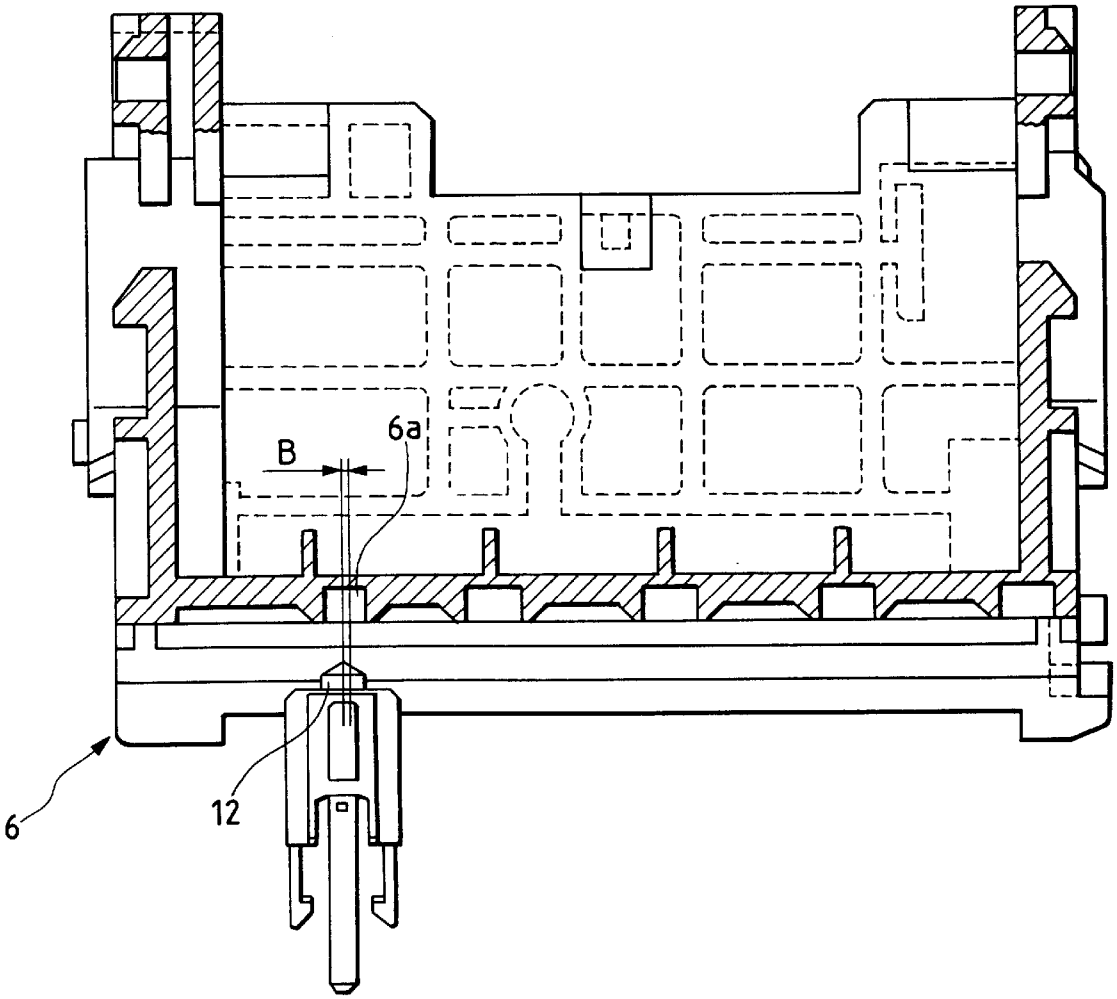
FIG. 4 is a sectional view taken along the line A—A in FIG. 1, showing a condition that the carriage is offset from a cap position in design.
Figure 5:
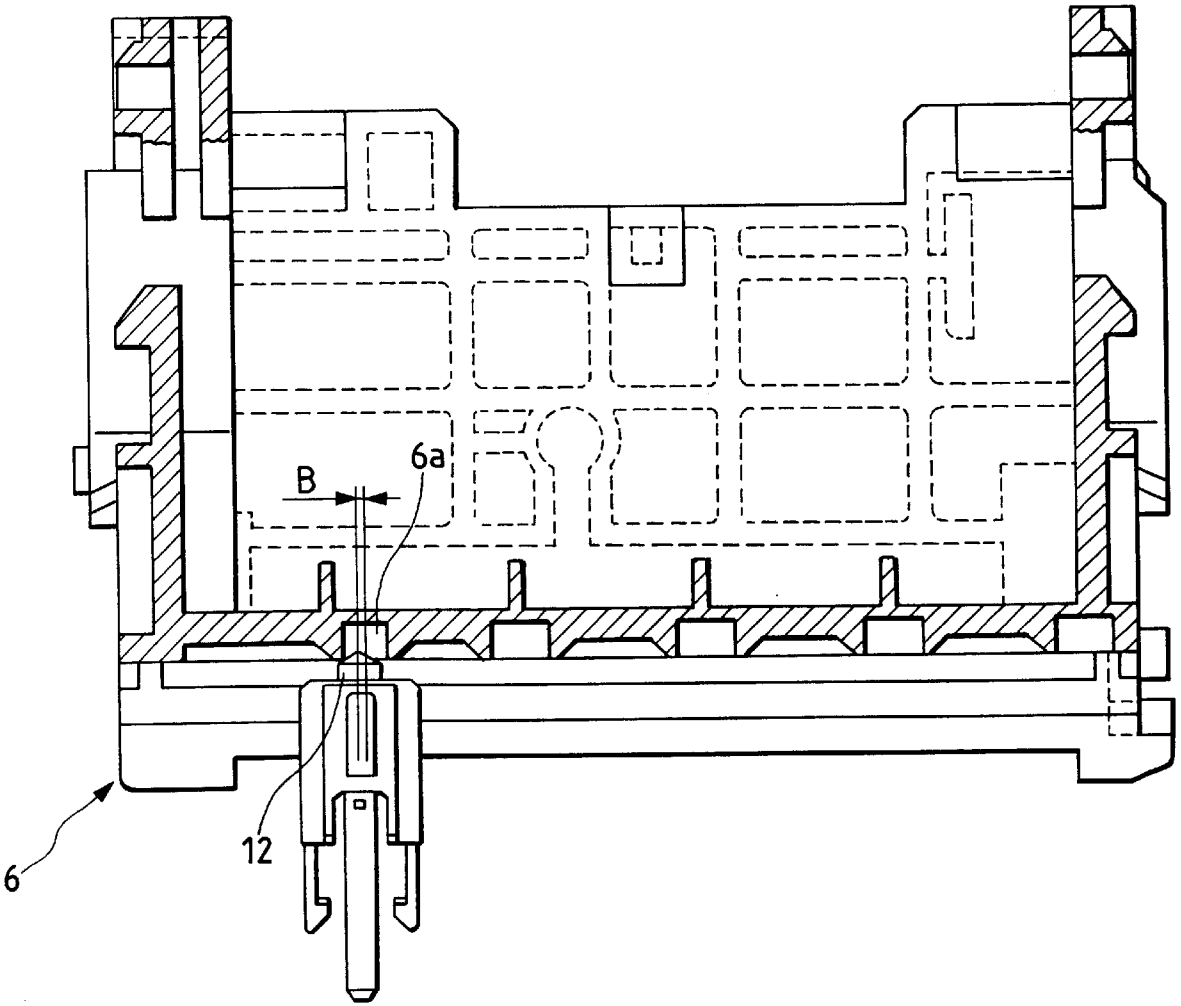
FIG. 5 is a sectional view similar to FIG. 4, showing a condition that the rod-like member is moved in an upward direction.

FIG. 4 shows a condition that the carriage position is deviated from the design position by an offset amount of B. In this condition, when the rod-like member 12 is further moved upwardly, since an entrance portion of the recessed portion 6*a* is tapered and the rod-like member 12 has a tapered tip end, the rod-like member 12 is eventually fitted into the recessed portion 6*a* as shown in FIG. 3 while moving the carriage 6 to the left (FIG. 4) by a distance of B.

In this case, the distance B corresponding to the moved amount of the carriage 6 is counted by the sensor portion of the magnetic linear encoder arranged on the carriage 6, and a counted value is written in an EP-ROM and the like of the apparatus as a correction value. In this way, when the carriage 6 is moved to the capping position next time, the moving movement of the carriage is controlled in consideration of the correction value, with the result that the carriage can be moved to the design capping position accurately. As a result, the ink discharge at the correct position, and the positive sucking and capping operations can be ensured. Further, even if the carriage position is deviated from the design position by repeating the capping operations, the carriage can be always positioned correctly by always fitting the rod-like member 12 into the recessed portion 6*a*.

Second Embodiment

Next, a second embodiment of the present invention will be explained with reference to FIGS. 6 to 9. Similar to FIGS. 2 to 5 relating to the first embodiment, FIGS. 6 to 9 are sectional views taken along the line A—A in FIG. 1, and, in FIGS. 6 to 9, the positions of the carriage 6 are shown as positions occupied by the carriage when the latter is moved to the sucking recovery position on the basis of the home position. In FIGS. 6 to 9, a recessed portion 6*b* formed in the carriage 6 is an elongated opening elongated in the carriage scanning direction, unlike the circular recessed portion 6*a* in the first embodiment.

Figure 6:
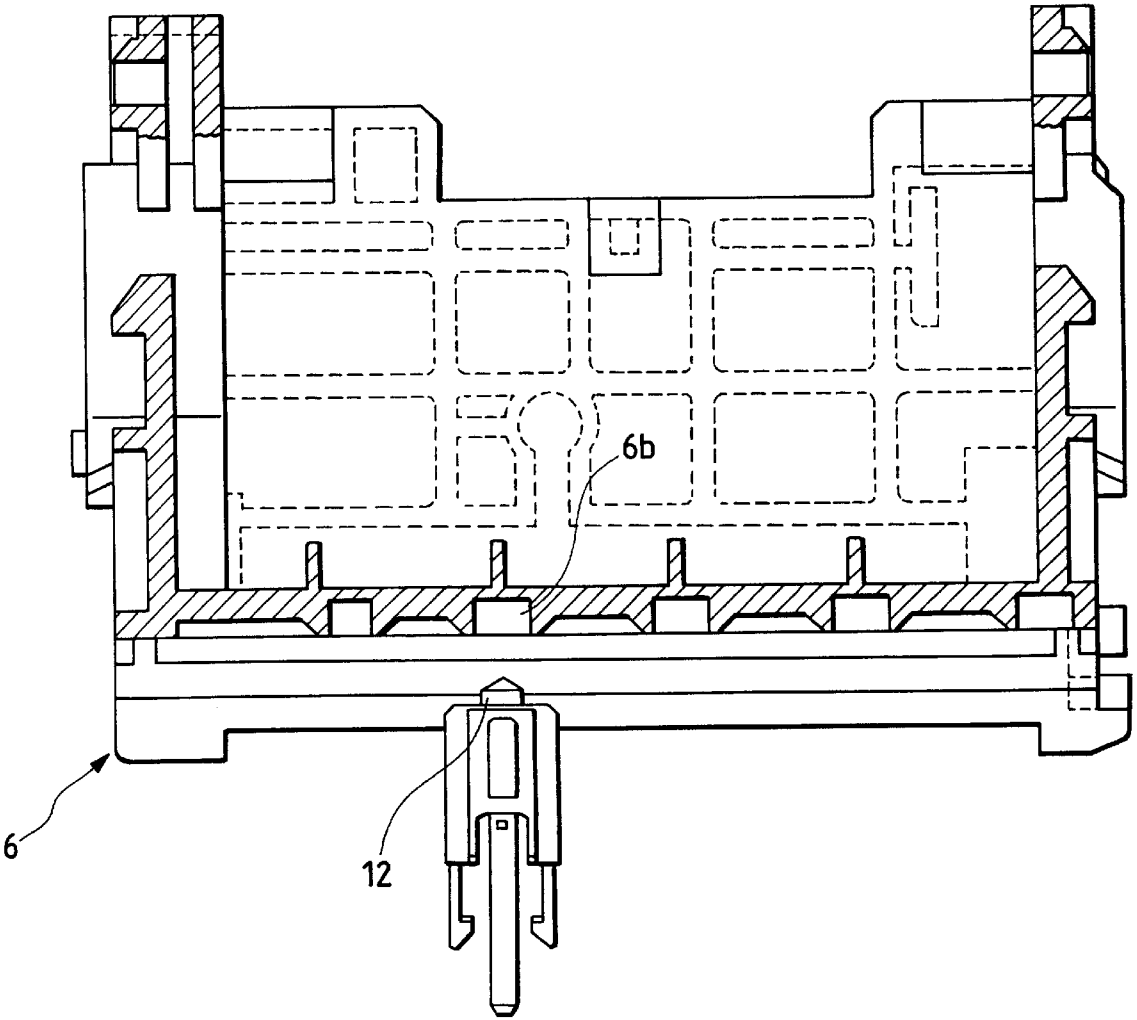
FIG. 6 is a sectional view of a carriage of a recording apparatus according to a second embodiment of the present invention, taken along the line A—A in FIG. 1, showing a condition that the carriage is in a sucking position.
Figure 7:
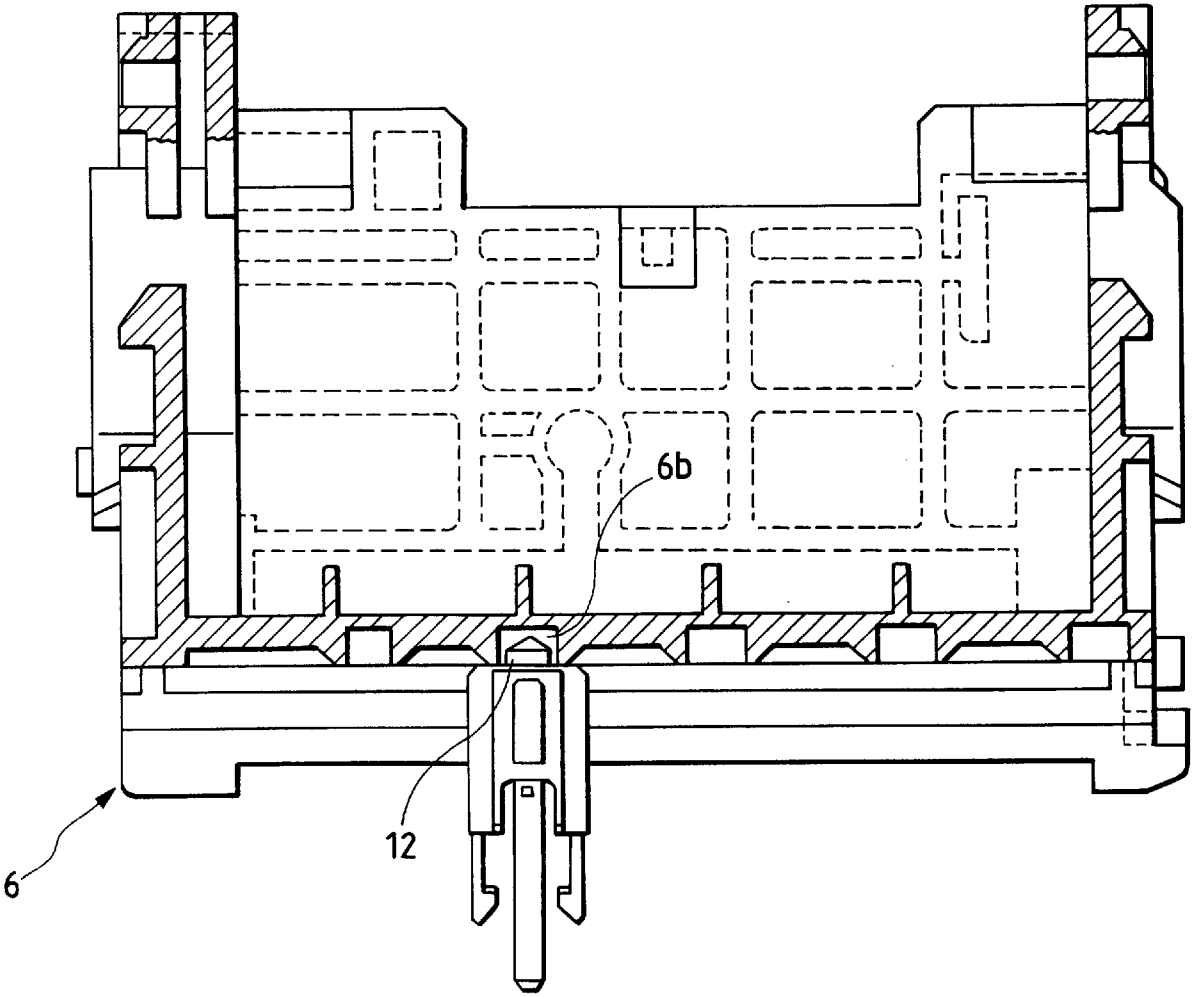
FIG. 7 is a sectional view similar to FIG. 6, showing a condition that a rod-like member is moved in an upward direction.

When the rod-like member 12 is moved upwardly from a condition shown in FIG. 6, a condition shown in FIG. 7 is reached. In this case, since the recessed portion 6*b* is the elongated opening, even if the carriage position determined on the basis of the home position is deviated from the design position as explained in connection with the first embodiment, the rod-like member 12 can easily be fitted into the recessed portion 6*b*.

Figure 8:
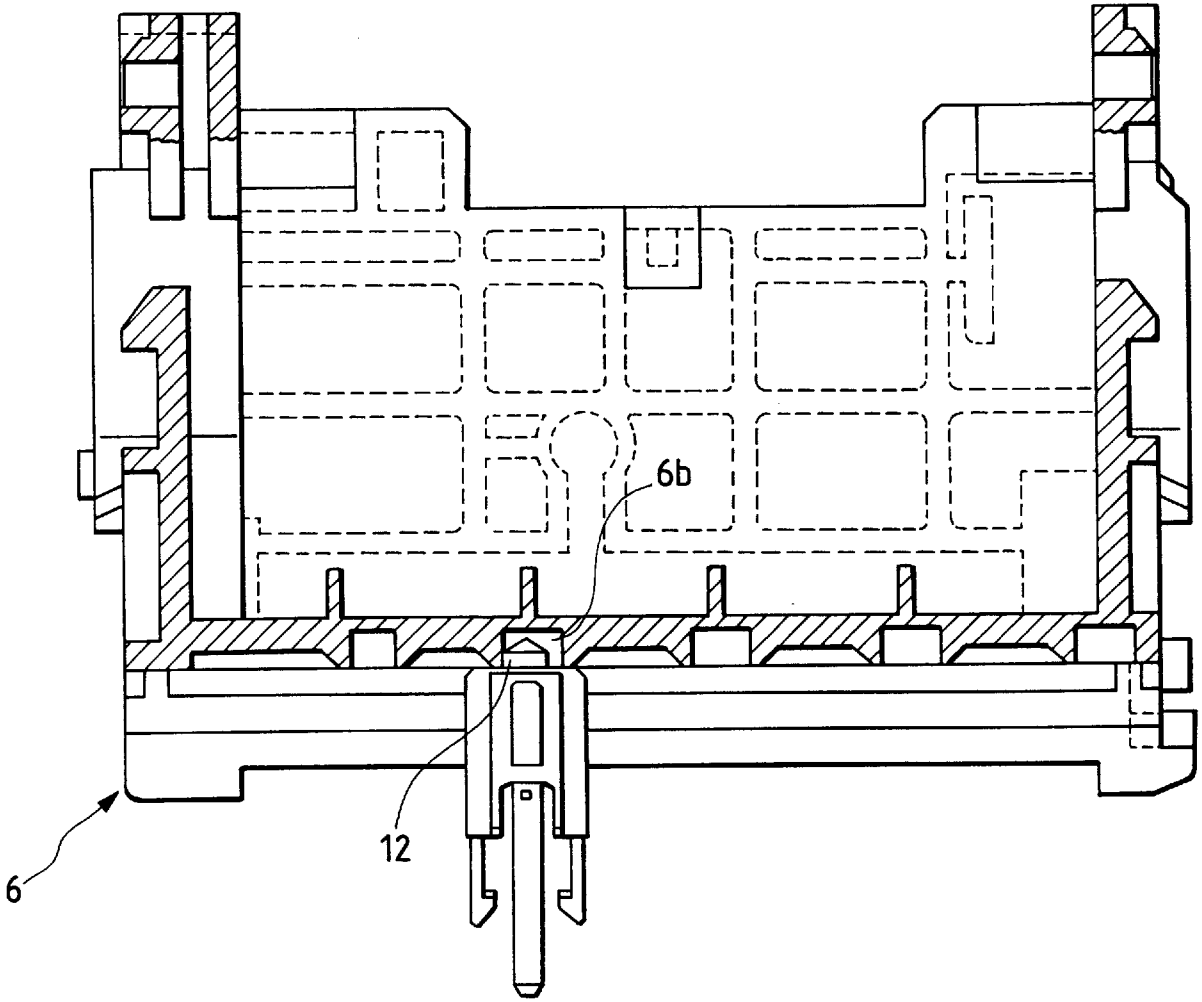
FIG. 8 is a sectional view similar to FIG. 7, showing a condition that the carriage is abutted against a left end of the rod-like member.

From this condition, when the carriage 6 is shifted to the right (FIG. 7) until a left end of the rod-like member 12 is abutted against a left inner wall of the recessed portion 6*b*, a condition shown in FIG. 8 is reached. At this point, the position of the carriage 6 is stored in the control portion of the apparatus.

Figure 9:
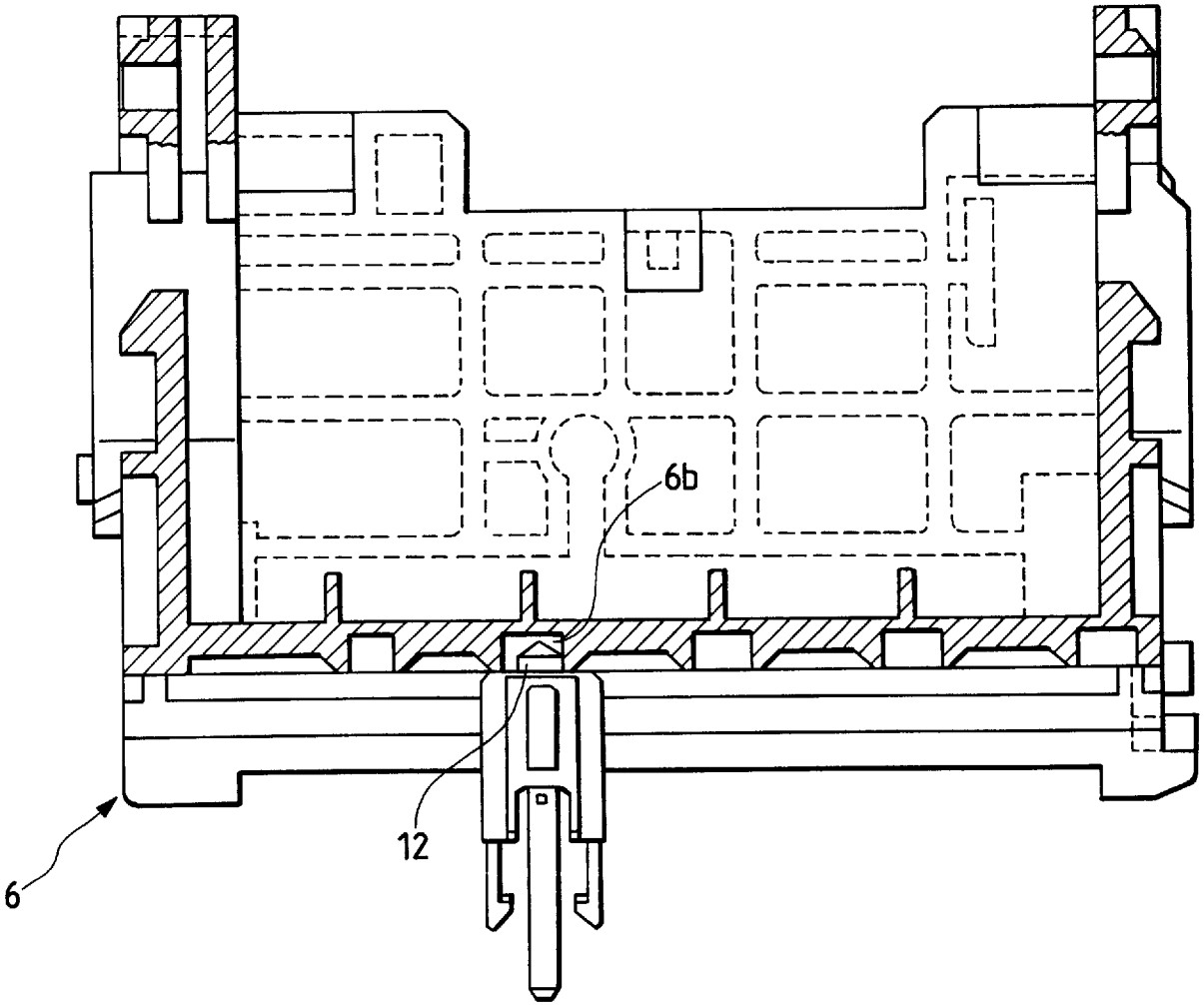
FIG. 9 is a sectional view similar to FIG. 7, showing a condition that the carriage is abutted against a right end of the rod-like member.

Then, from this condition, when the carriage 6 is moved to the left (FIG. 8) until a right end of the rod-like member 12 is abutted against a right inner wall of the recessed portion 6*b*, a condition shown in FIG. 9 is reached. At this point, if an intermediate position between the position of the carriage 6 and the carriage position stored in the condition of FIG. 8 is coincided with the position of the carriage 6 shown in FIGS. 6 and 7, it is considered that the carriage position determined on the basis of the home position is coincided with the design position. However, if the intermediate position is deviated from the design position, a deviated amount is written in the EP-ROM and the like. In this way, when the carriage 6 is moved next time, the movement of the carriage is controlled in consideration of the correction value, with the result that the ink discharge at the correct position, and the positive sucking and capping operations can be ensured, as is in the first embodiment.

Incidentally, in the first embodiment, while an example that the rod-like member 12 has the tapered tip end to move the carriage 6 by the upward movement of the rod-like member arid the recessed portion 6*a* of the carriage 6 is deep sufficient to receive the tip end of the rod-like member was explained, in the second embodiment, since it is not required to move the carriage 6 by the rod-like member 12, the tip end of the rod-like member 12 may be flat and the recessed portion 6*b* may be made shallower to receive the flat tip end of the rod-like member. Also in this case, the same technical advantages as those of the first embodiment can be obtained.

Figure 10:
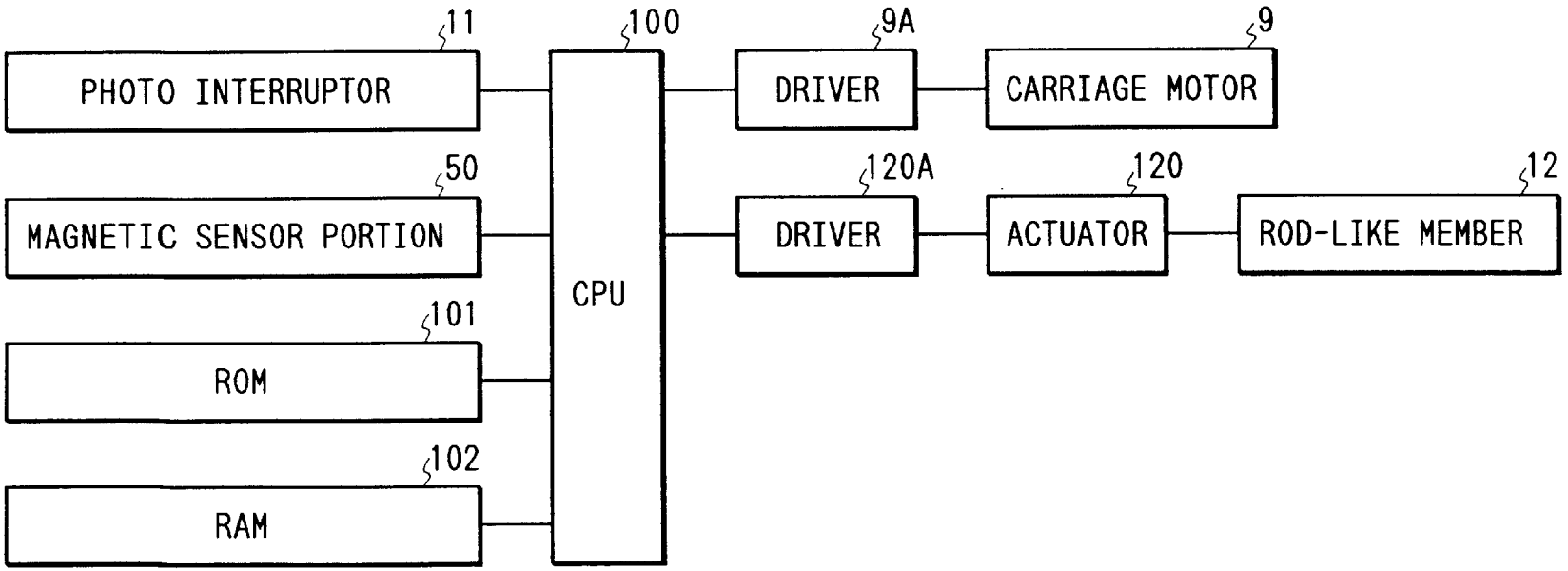
FIG. 10 is a block diagram for controlling a moving movement of the carriage.

FIG. 10 is a block diagram for controlling the position of the carriage according to the first and second embodiments.

In FIG. 10, a CPU 100 serves to control the driving of the carriage motor 9 to move the carriage 6 on the basis of a carriage detection output from the photo-interrupter 11 and a detection output from the sensor portion of the magnetic linear encoder and to control the driving of an actuator 120 to move the rod-like member 12 upwardly or downwardly. The correction value determined by the positional relation between the rod-like member 12 and the recessed portion (6*a* or 6*b*) of the carriage 6 is stored in a RAM 102. A ROM 101 serves to store the above-mentioned various processes or procedures explained in connection with the first and second embodiments.

Incidentally, in the first and second embodiments, while the magnetic linear encoder was arranged in the recording apparatus, an optical linear encoder comprising a scale portion formed from a slit-shaped film and a sensor of light-permeable type or light-reflection type may be used. In this case, so long as the other structural elements are not changed, the same technical advantages can be obtained.

Further, in the first and second embodiments, in place of the encoder arranged in the recording apparatus, a magnetic or optical rotary encoder may be arranged on the carriage motor for driving the carriage. Also in this case, so long as the other structural elements are not changed, the same technical advantages can be obtained.

Further, the recessed portion formed in the carriage may be a through opening.

Others

Incidentally, when the present invention is applied to an ink jet recording apparatus, particularly, a recording apparatus having a recording head including a means (for example, electrothermal converters or laser beam generators) for generating thermal energy utilized to discharge ink and in which the condition of the ink is changed by the thermal energy, the excellent advantage can be obtained. In this case, high density and high fineness of the recording can be achieved.

Preferably, the typical construction and principle thereof can be realized by using the fundamental principles, for example, disclosed in U.S. Pat. Nos. 4,723,129 and 4,740,796. Although this system can be applied to both a so-called "on-demand type" and "continuous type", it is more effective when the present invention is particularly applied to the on-demand type, because, by applying at least one drive signal corresponding to the record information and capable of providing the abrupt temperature increase exceeding the nucleate boiling to the electrical/thermal converting elements arranged in correspondence to the paper or liquid passages including the liquid (ink) therein, it is possible to form a bubble in the liquid (ink) in correspondence to the drive signal by generating the film boiling on the heat acting surface of the recording head due to the generation of the thermal energy in the electrical/thermal converting elements. Due to the growth and contraction of the bubble, the liquid (ink) is discharged from the discharge opening to form at least one ink droplet. When the drive signal has a pulse shape, since the growth and contraction of the bubble can be quickly effected, more excellent ink discharge is achieved. Such pulse-shaped drive signals may be ones disclosed in U.S. Pat. Nos. 4,463,359 and 4,345,262. Incidentally, by adopting the condition disclosed in U.S. Pat. No. 4,313,124 providing the invention regarding the temperature increasing rate on the heat acting surface, a further excellent recording can be performed.

As the construction of the recording head, the present invention includes the construction wherein the heat acting portion is disposed in an arcuate area as disclosed in U.S. Pat. Nos. 4,558,333 and 4,459,600, as well as the constructions wherein the discharge openings, liquid paths and electrical/thermal converting elements are combined (straight liquid paths or orthogonal liquid paths). In addition, the present invention can applicable to the construction wherein each discharge opening is constituted by a slit with which a plurality of electrical/thermal converting elements associated in common as disclosed in the Japanese Patent Appln. Laid-Open No. 59-123670 and the construction wherein openings for absorbing the pressure wave of the thermal energy are arranged in correspondence to the discharge openings as disclosed in the Japanese Patent Appln. Laid-Open No. 59-138461, because the recording can be correctly and effectively performed regardless of the configuration of the recording head.

In addition, among the above-mentioned serial types, the present invention is effectively applicable to a removable recording head of chip type wherein, when mounted on the recording system, electrical connection between it and the recording system and the supply of ink from the recording system can be permitted, or to a recording head of cartridge type wherein a cartridge is integrally formed with the head.

Further, it is preferable that a head recovering means and an auxiliary aiding means are added to the recording head according to the present invention, since the effect of the present invention is further improved. More concretely, these means include a capping means for capping the recording head, cleaning means, pressurizing or suction means, an auxiliary heating means comprising electrical/thermal converters or other heating elements or the combination thereof, and an auxiliary discharge means wherein the ink discharge regardless of the recording ink discharge is effected.

Further, in the illustrated embodiments, while the ink was liquid, the ink may be solid in a room temperature or less, or may be softened at a room temperature. In the above-mentioned ink jet recording system, since the temperature control is generally effected in a temperature range from 30° C. to 70° C. so that the viscosity of the ink is maintained within a stable discharging range, the ink may be liquidized when the record signal is emitted. In addition, ink having a feature that is firstly liquidized by the thermal energy, such as solid ink which serves to prevent the increase in temperature by absorbing energy in changing the ink from the solid state to the liquid state or which is in the solid state in the preserved condition to prevent the vaporization of ink and which is liquidized into ink liquid to be discharged in response to the record signal comprising the thermal energy, or ink which has already been solidified upon reaching the recording medium, can also be applied to the present invention. In such a case, the ink can be held in the liquid state or solid state in recesses or holes in porous sheet as disclosed in the Japanese Patent Appln. Laid-Open Nos. 54-56847 and 60-71260, in confronting relation to the electrical/thermal converters. Incidentally, in the present invention, the above-mentioned film boiling principle is most effective for each ink.

In addition, the ink jet recording apparatus according to the present invention can be used as an image output terminal of information process equipment such as a computer, a copying machine combined with a reader and the like, and a facsimile system having a communication function.

What is claimed is:

1. A positioning method for positioning a recording head mounted on a movable carriage, said method comprising the steps of:

detecting an offset amount of a distance between a moving position of the carriage and a recovery position for recovering the recording head, generated when the carriage is contacted with a member arranged at the recovery position, by utilizing encoder means for detecting the moving position of the carriage; and correcting the moving position of the carriage in accordance with the offset amount detected in said detecting step.

2. A method according to claim 1, further comprising the step of:

recovering the recording head after correcting the moving position in said correcting step.

3. A method according to claim 2, wherein the recording head comprises an ink jet recording head and in said recovering step the recording head is suctioned and capped.

4. A recording apparatus comprising:

a movable carriage for mounting a recording head for recording an image on a recording medium;

encoder means for detecting a moving position of said carriage;

a member arranged at a recovery position for recovering the recording head within the recording apparatus in a moving path of said carriage so that said member can be contacted with a portion of said carriage;

detection means for detecting a moved amount of said carriage in a carriage moving direction generated when said carriage is contacted with said member; and correction means for correcting the moving position of said carriage, based on the moved amount detected by said detection means and the recovery position where said member is arranged.

5. A recording apparatus according to claim 4, wherein said portion of said carriage comprises a recessed portion having a tapered entrance portion, and said member comprises a rod-like member which can be contacted with said carriage by fitting into said recessed portion.

6. A recording apparatus according to claim 4, wherein said portion of said carriage comprises an elongated opening elongated in the moving direction of said carriage and having two end inner walls, and said member comprises a rod-like member which can be moved within said elongated opening to be contacted with either of said two end inner walls of said elongated opening.

7. A recording apparatus according to claim 6, wherein said recording head comprises means for generating thermal energy and can generate a bubble in ink by utilizing the thermal energy, thereby discharging the ink due to growth of the bubble.

8. A recording apparatus according to claim 4, wherein said recording head comprises means for generating thermal energy and can generate a bubble in ink by utilizing the thermal energy, thereby discharging the ink due to growth of the bubble.

* * * * *

UNITED STATES PATENT AND TRADEMARK OFFICE

CERTIFICATE OF CORRECTION

PATENT NO. : 5,992,970

DATED : November 30, 1999

INVENTOR(S) : UNOSAWA ET AL.

It is certified that error appears in the above-identified patent and that said Letters Patent is hereby corrected as shown below:

On the title page, item

[56] References Cited:

U.S. PATENT DOCUMENTS, "4,725,129" should read --4,723,129--.

COLUMN 5:

Line 50, "arid" should read --and--.

Signed and Sealed this

Ninth Day of January, 2001

*Attest:*

*Attesting Officer*

Q. TODD DICKINSON

*Commissioner of Patents and Trademarks*